US010392844B2

(12) United States Patent
Kreyenborg et al.

(10) Patent No.: US 10,392,844 B2
(45) **Date of Patent: *Aug. 27, 2019**

(54) ROLLER CARRIAGE FOR THE RECEPTION OF A SLIDING DOOR HAVING AT LEAST TWO MOUNTING DEVICES

(71) Applicant: DORMA Deutschland GmbH, Ennepetal (DE)

(72) Inventors: Ralf Kreyenborg, Ennepetal (DE); Sven Busch, Ennepetal (DE); Jan-Hendrik Jahnke, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 490 days.

This patent is subject to a terminal disclaimer.

(21) Appl. No.: 14/938,786

(22) Filed: Nov. 11, 2015

(65) Prior Publication Data

US 2016/0138315 A1 May 19, 2016

(30) Foreign Application Priority Data

Nov. 14, 2014 (EP) ..... 14193362

(51) Int. Cl.

| | |
|---|---|
| ***E05D 13/00*** | (2006.01) |
| ***E05D 15/06*** | (2006.01) |
| ***E06B 3/46*** | (2006.01) |
| ***E06B 3/54*** | (2006.01) |

(52) U.S. Cl.

CPC ..... *E05D 15/0647* (2013.01); *E05D 15/063* (2013.01); *E05D 15/0634* (2013.01); *E05D 15/0652* (2013.01); *E06B 3/4636* (2013.01); *E06B 3/5454* (2013.01); *E05Y 2201/614* (2013.01); *E05Y 2201/64* (2013.01);

(Continued)

(58) Field of Classification Search

CPC ..... E05D 15/0634; E05D 15/0656; E05D 15/0691; E05D 15/0669; E05D 15/0643; E05D 15/0682; E05D 15/0686

USPC ..... 49/409, 425

See application file for complete search history.

(56) References Cited

U.S. PATENT DOCUMENTS 2,940,113 A * 6/1960 Riser ..... E05D 15/063 16/105

3,425,162 A * 2/1969 Halpern ..... E05D 15/0634 16/105

(Continued)

FOREIGN PATENT DOCUMENTS

EP 2886763 * 6/2015

*Primary Examiner* — Jerry E Redman

(74) *Attorney, Agent, or Firm* — Cantor Colburn LLP

(57) ABSTRACT

A roller carriage for the reception of a sliding door includes a roller module for the displaceable affixing at a roller running path and a basic body for the attachment to the sliding door, wherein at least two mounting devices are provided for realizing respectively one mounting function of the roller carriage. Each mounting device includes at least one mounting element with a manipulation interface for applying a mounting force for performing a mounting movement of the mounting element. The manipulation interfaces of the mounting elements of the at least two mounting devices are disposed on a first side of the roller carriage, and a bearing device of the roller module for the displaceable affixing at the roller running path is disposed on the opposing second side of the roller carriage.

11 Claims, 7 Drawing Sheets

(52) U.S. Cl.
CPC ... *E05Y 2600/456* (2013.01); *E05Y 2800/205* (2013.01); *E05Y 2900/132* (2013.01)

(56) References Cited

U.S. PATENT DOCUMENTS

| | | | | |
|---|---|---|---|---|
| 5,598,666 | A * | 2/1997 | Kurth | A47K 3/34 4/557 |
| 6,698,138 | B1 * | 3/2004 | Lin | E05D 15/0639 16/105 |
| 7,065,831 | B2 * | 6/2006 | Elmer | E05D 15/0652 16/106 |
| 9,038,316 | B2 * | 5/2015 | Von Gerichten | E05D 15/063 49/360 |
| 9,085,924 | B2 * | 7/2015 | Tidwell | E05D 15/0669 |
| 9,834,969 | B2 * | 12/2017 | Kreyenborg | E05D 15/0643 |
| 2009/0229184 | A1 * | 9/2009 | Hideki | B66B 13/08 49/70 |
| 2011/0005140 | A1 * | 1/2011 | Guidos | A47K 3/30 49/425 |
| 2013/0111702 | A1 * | 5/2013 | Ewing | E05D 15/0634 16/91 |
| 2014/0310913 | A1 * | 10/2014 | Horwood | E05D 15/0669 16/100 |
| 2015/0026928 | A1 * | 1/2015 | Haab | E05D 15/0652 16/96 R |
| 2015/0074942 | A1 * | 3/2015 | Haab | E05D 15/0634 16/102 |
| 2015/0211275 | A1 * | 7/2015 | Terno | E05D 15/0652 16/93 R |

* cited by examiner

ROLLER CARRIAGE FOR THE RECEPTION OF A SLIDING DOOR HAVING AT LEAST TWO MOUNTING DEVICES

FIELD

The present disclosure relates to a roller carriage for the reception of a sliding door having at least two mounting devices, as well as to a sliding door installation having at least one corresponding roller carriage.

BACKGROUND

Basically, it is known that roller carriages are employed for the reception of sliding doors. Said roller carriages are inserted with corresponding bearing devices into roller running paths, which are attached to a wall or to the ceiling above a door opening. Subsequently, the sliding door can perform an opening movement and a closing movement by a movement of the roller carriage along said roller running path. In this case, such a roller carriage includes the most various functions, which structurally are provided by means of corresponding mounting devices. One such additional function consists for example in a height adjusting device, in order to perform an adjustment of the height of the sliding door. Other examples of such mounting functions consist for example in mounting accessory modules, an attachment device of a sliding door to a basic body or the like.

In the known roller carriages, the individual mounting devices are specific for the respective mounting function to be fulfilled. Accordingly, a specific orientation of the associated mounting devices is realized for performing a mounting movement for the respective mounting function.

Each of said mounting devices is a self-contained system, which operates consistently.

However, this results in that the mounting function needs to be fulfilled for each mounting device in a specific manner by means of specific mounting movements or specific engagement options. Furthermore, in the simplest case, this results in performing the respective mounting function from different sides of the roller carriage. However, it may likewise even result in that prior to performing a mounting function, the installation technician in question, needs to research, where the corresponding manipulation interface for performing the respective desired specific mounting function is located. This translates into increased mounting expense and a longer mounting time. Also, the complexity of such a roller carriage is increased in this way.

Therefore, the present disclosure overcomes the above-described disadvantages, at least partially in a cost-efficient and simple manner. Specifically, the present disclosure reduces the time required for mounting as well as the complexity of the roller carriage.

SUMMARY

Features and details, described in conjunction with the inventive roller carriage are obviously also valid in conjunction with the inventive sliding door installation as well as with the inventive method, and respectively vice versa, such that mutual reference is made, respectively can be made with respect to the disclosure of individual aspects of the invention.

According to the disclosure, a roller carriage is provided for the reception of a sliding door. Said roller carriage includes a roller module for the displaceable affixing at a roller running path. Furthermore, a basic body is provided for the attachment to the sliding door. An inventive roller carriage is distinguished in that at least two mounting devices are provided for performing one respective mounting function of the roller carriage. In this case, each mounting device includes at least one mounting means with a manipulation interface for inserting a mounting force for performing a mounting movement of the at least one mounting means. Furthermore, the manipulation interfaces of the mounting means of the at least two mounting devices are disposed on a first side of the roller carriage. A bearing device of the roller module for the displaceable attachment to the roller running path is disposed on a second side of the roller carriage, which is opposite the first side.

An inventive roller carriage includes in particular at least two structural components, namely the roller module and the basic body. In this case, obviously further structural components may be provided and/or said two structural components may be composed of individual bodies. A roller carriage according to the idea of the present disclosure is an overall system, which fulfills at least two functions. On the one hand, the roller module allows for the displaceable affixing on the roller running path. Even if, already in this stage, the terminology of roller is utilized, an affixing of bearing devices for rollers represents only one optional embodiment of an inventive roller carriage. Obviously for the displaceable bearing, such a roller carriage may include a linear guidance, for example an anti-friction bearing or a linear drive. However, with regard to reduced complexity and reduced cost, the embodiment with rotatable rollers is preferred for such a bearing device. The second function provides the attachment of the sliding door. In this case, the attachment may be a clamped attachment.

According to the disclosure, the roller module and the basic body are separate structural components, respectively separate bodies. Each one of said two structural components, namely the roller module and/or the basic body, may in turn include a plurality of individual components, which are connected among each other. Thus, the roller module may include for example corresponding bearing devices in the shape of rotatably supported rollers. The basic body may include a plurality of individual structural components, such as for example further devices for additional functions. In addition to a height adjustment, they may as well include a securing device, a fixing device or else a clamping device, by means of which the sliding door can be attached to the basic body.

Basically and according to the disclosure, the direction of movement by means of the roller carriage is freely selectable. Thus, in this case within the scope of the present disclosure, a movement along a straight can be performed just as well as a movement along a line of movement, which is curved or curved several times, is conceivable.

In this case, a displaceable affixing at a roller running path is to be understood for the respective embodiment of the bearing. In case bearing devices in the shape of individual rollers are provided, said rollers are inserted into a corresponding roller running path. If for example an anti-friction bearing is provided, affixing the roller module is realized on a corresponding sliding rail, respectively at a corresponding sliding rail.

Preferably, the roller module is manufactured from steel casting material. The basic body may be lighter and manufactured for example from light metal diecast. As light metal diecast, in particular aluminum or zinc are utilized.

According to the disclosure, the roller carriage is now equipped with at least two mounting devices. Said two mounting devices are preferably configured to be able to provide two different mounting functions. The mounting devices have in common that they each include at least one mounting means. The mounting means is in this case configured as a manipulation interface such that a corresponding interface is provided for engaging the mounting force, respectively the mounting movement. In other words, the mounting means are supported to be movable in the mounting device or in other structural components of the roller carriage for performing the corresponding mounting movements. In this case, the mounting movement is directed to fulfill the desired and specific mounting function. If for example a mounting device is provided in the shape of height adjusting device, the mounting movement of the corresponding mounting means is directed to perform an adjustment of the height. In case the mounting device includes a lift-off protection device, the associated mounting means for the related mounting movement is adapted to perform a corresponding movement, for example between a protection position and a release position of such a lift-off protection device. The actual axis of movement, the type of movement force, as well as the type of mounting movement depend in this case on the respective specific mounting function of the corresponding mounting device.

In an inventive roller carriage, it is decisive that the latter includes at least two distinct sides. In this case, a corresponding side does not necessarily have to be a flat termination, but may rather represent a plurality of different structural components, which can be seen, respectively acted upon from the corresponding side. In this case, in particular the long sides are defined as a first side and as a second side of a roller carriage. A bearing device of the roller module is disposed on a second side for the correspondingly desired displaceable affixing at the roller running path. Such a bearing device may include for example a sliding rail or a sliding means. However, rollers are likewise conceivable as the bearing device, which can be placed onto the corresponding roller running path in a rolling manner. Obviously, such bearing devices may include additional means, for example rotational bearings for such rollers. The second side, which can also be designated as the backside, is thereby unambiguously defined. Said second side, respectively said backside, after being inserted into the roller running path, is located parallel or essentially parallel to the roller running path, respectively to the wall above the door opening. In addition, said second side is located directly opposite the roller running path, respectively the wall above the door opening. Said area is thus concealed against engagement, respectively access, by the roller carriage itself from the one side and by the roller running path, respectively the wall above the door opening from the other side.

The first side is oriented opposite the second side. When just focusing on the two long sides of the roller carriage, which so to say extend along the possible direction of movement the roller carriage, said first side is so to say the forefront or the front side of the roller carriage. In the installed condition, as already explained, said first side, and thereby the front side, is located on the opposite side of the backside and therefore points away from the wall above the door opening. In other words, the installation technician can inspect said first side, as the front side, and directly act on all structural components.

According to the disclosure, the definition of said two sides is of major importance. The opposing configuration of said two sides and the opposing disposition of the mounting devices, respectively of the manipulation interfaces thereof, on the one hand, and of the bearing device, on the other hand, provides the safety that the manipulation interfaces are disposed on the first side and therefore on the front side, where they can be inspected and worked on. According to the disclosure, this results in that fact that for at least two mounting devices, preferably for all mounting devices the manipulation interfaces are likewise accessible from the forefront, respectively the front side, namely the first side. This arrangement results furthermore in that the mounting procedure itself can be performed quicker, simpler and at less complexity. So, extensive searching for the corresponding manipulation interface of one of said at least two mounting devices is no longer required, because they are located directly in the visible area on the first side. Simultaneously, a mounting procedure is quicker, because it is possible to change a lot quicker between the two mounting devices, when the two corresponding mounting functions are performed one after the other. Also an interaction between two different mounting functions can be provided in this way a lot quicker by the variation of a corresponding manipulation tool.

Basically, it should be pointed out, that in an inventive roller carriage obviously and essentially an optional number of mounting devices can be provided. In this case, it is decisive that at least two of said plurality of mounting devices include the mounting means and the manipulation interfaces according to the disclosure. In addition, for example a third mounting device may be provided, which, within the scope of the present disclosure, may include a correspondingly differently oriented mounting means, respectively manipulation interface. However, it is preferred, as will be explained later, that all manipulation interfaces present the corresponding common and same orientation on the first side.

It may be advantageous, if, in an inventive roller carriage, the manipulation interfaces of all mounting devices are disposed on the same side of the roller carriage. This means, that even, if a plurality of different mounting devices is disposed at a roller carriage, not only at least two of said inventive mounting devices present the inventive quality, but that rather the entire number of all mounting devices is aligned in the same inventive way. Thereby, the inventive advantage of the correlation between different mounting functions of different mounting devices is expanded to all mounting devices and thereby to all mounting functions. The reduced complexity with regard to mounting and the structure of the roller carriage is thereby even further improved. The serviceability is likewise made considerably easier by said expansion.

It is likewise advantageous, if, in an inventive roller carriage, all manipulation interfaces include at least one form closure portion, which forms an at least sectionwise form closure with an interface portion of a uniform manipulation tool. Comprised in said example are solutions of a cross-headed screwdriver, a slotted screwdriver or solutions of corresponding wrench sizes of hexagon wrenches or fork-wrenches, respectively ring wrenches. In this case, these are obviously only possible examples, because also a non-standard form of such a form closure is conceivable according to the idea of the disclosure, with the intention to provide a securing means against unwanted dismounting or mounting. The combination of different mounting devices with identical or essentially identical form closure portions allows now for employing a uniform manipulation tool for the at least two different mounting devices. During the mounting procedure, this provision results in reduced complexity and reduced time expense, because an installation technician, who stands on a ladder in a mounting position for performing a first mounting function at the first mounting device, does not have to change tools for performing a second mounting function at a second mounting device in the same way and likewise in a frontal adjusting option. Thus, the inventive advantages are even further improved.

It may be likewise advantageous, if, in an inventive roller carriage, all mounting means include a bearing for a mounting movement of the same or of the essentially same type of movement. This means, that a type of movement can be defined for the respective mounting means. Such a type of movement refers in particular to an orientation of a corresponding axis of movement. Basically, a type of movement of a mounting movement is understood as its effect. A type of movement may be for example a rotary motion. Also a translatory, respectively a linear displacement may represent a type of movement. Obviously, a corresponding type of movement of the mounting movement may be considerably more complex and in particular composed of several different individual movements. The inventive correlation, meaning that now all mounting means include a positioning having the corresponding same type of movement, likewise reduces the complexity in an inventive roller carriage, in particular with regard to the mounting thereof. Again, for example, when employing threaded bolts as the mounting means, a rotary motion may represent the mounting movement for all mounting means. In this way, the necessary capability and the correspondingly associated complexity are reduced for the installation technician. In this case, the type of movement is in particular not only the same or essentially the same with regard to quality, but also in particular with regard to quantity. Based on the example of a configured thread this means that in particular the same thread pitches and/or in particular the same thread sizes are provided.

It is furthermore advantageous, if, in an inventive roller carriage, at least one of the following mounting devices is provided:

- height adjusting device for a height adjustment of the basic body in relation to the roller module in a direction of gravity,
- attachment device for an attachment of the sliding door to the basic body,
- lift-off protection device for protecting against a lifting of the roller carriage out of the roller running path,
- securing device for a secured affixing of the displaceable bearing of the basic body at the roller module,
- accessory device for the attachment of an accessory module to the basic body and/or to the roller module.

The above enumeration is considered to be a non-exhaustive list. In particular for all said mounting devices, a rotary motion is performed as the type of movement for the mounting movement. A height adjusting device is understood to provide the possibility of a height variation of the sliding door in relation to the roller running path. The latter has in particular an effect on a height adjustment between the basic body and the roller module. An attachment device according to the idea of the present disclosure is configured for attaching the sliding door. For example glass clamps can be employed for this purpose, in order to fulfill said attachment function as a mounting function. A lift-off protection device serves to prevent with high certainty from any unwanted removal of the roller carriage from the roller running path. This protection is not only directed to active lifting-off, but also to any unwanted jumping when impacting against a terminal position. A securing device is intended in particular for a reliable fixing of the positioning of the two structural components next to each other, in order, for example in combination with a height adjusting device, to relieve the latter from the occurring applied forces in the application situation. An accessory device serves the purpose to increase the flexibility of a corresponding roller carriage. Thereby, affixing additional modules at a roller carriage, which in this way is configured to be universal, can provide a plurality of different additional functions. In this case, in particular a combination of mounting devices is configured according to any of the following:

height adjusting device including the lift-off protection device;

height adjusting device including the attachment device;

lift-off protection device including the attachment device;

height adjusting device including the lift-off protection device and the attachment device.

It is likewise advantageous, if, in an inventive roller carriage, all mounting means include an axis of movement for the mounting movement, wherein said axes of movement are oriented parallel or essentially parallel with regard to each other. In this case, such axes of movement may act on both, a linear displacement and a rotary motion for the mounting movement. Likewise combinations of different types of mounting are obviously conceivable when utilizing parallel axes of movement. If for example a plurality of mounting means is configured as threaded bolts, the axes of the threads as the axes of movement of all said threaded bolts for said mounting means are oriented parallel or essentially parallel with regard to each other. Again, in the case of an installation technician, who, in front of the roller carriage, is in a position to mount, is likewise able to align his manipulation tool along said axes of movement, and a parallel lateral displacement is sufficient. While in the known roller carriages, it was not only required to change the manipulation tool frequently, but also the orientation thereof needed to be changed, in the present case, the mounting effort for placing the manipulation tool onto the appropriate manipulation interface is again reduced. An offset of said axes of movement for performing said parallel alignment amounts in this case in particular to less than 5°. In this case, in particular all mounting means of all mounting devices are concerned.

Furthermore, it is advantageous, if, in an inventive roller carriage, the bearing device of the roller module includes one, in particular at least two rotating rollers. By configuring a corresponding roller bearing, the bearing device is optimized with regard to friction and power of resistance. Also, wear and tear can be considerably reduced in this way. Last but not least, the entire manipulability of such a roller carriage has received a way higher intuitiveness. Basically, however, also other structural components, for example friction bearings or a magnetic drive are conceivable according to the idea of the present disclosure.

It may be advantageous, if, in an inventive roller carriage, all mounting means have the same or essentially the same mechanical load-bearing capacity with regard to accommodating the mounting force, in particular in the range of one of the following parameters.

torque≥5 Nm,

E-modulus≥210 kN/mm$^2$

The above enumeration is considered to be a non-exhaustive list. In this case, the above-indicated torque is understood to be the least possible torque prior to a mechanical failure. It is thereby ensured, that a torque required for the mounting procedure is lower than said minimum possible torque. In this case, at least the possible torque is in particular lower than 200 Nm and the E-modulus is in particular smaller than 300 kN/mm$^2$. The terminology of a same mechanical load-bearing capacity with regard to accommodating a mounting force in this case is understood to be a mechanical feedback to the installation technician. Thus, depending on the friction in a threaded path, when performing a mounting movement in a mounting means in the shape of a threaded bolt, different required torques are conceivable. Thus, tight screws may require a high torque, whereas easy-running screws having in particular a very steep thread can be screwed and unscrewed with a very low torque. According to the disclosure, the required force, respectively the corresponding mechanical resistance with regard to the applied mounting force, is preferably identical or essentially identical for all mounting means. This circumstance results in that the installation technician in a position for mounting is able to work on the roller carriage without having to pay too much attention to different mounting forces. Otherwise, there would be the risk, after having performed a mounting function with high mounting force, of applying the same high mounting force likewise for the following mounting function. In the event a mounting means of said following mounting function has a finer configuration, this could result in mechanical interference or damage of the mounting means in an unwanted way. Thereby, this embodiment increases the safety of an inventive roller carriage considerably with regard to the mounting procedure thereof.

Furthermore, it may be advantageous, if, in an inventive roller carriage, the basic body is supported to be displaceable at the roller module along a direction of gravity for an adjusting movement, wherein a first adjusting means for an adjusting movement is supported to be movable at the basic body, wherein, for a first movement of the basic body along a direction of gravity in relation to the roller module when performing the adjusting movement, the first adjusting means is in operative connection with a second adjusting means of the roller module.

According to the disclosure, now a height adjusting device may be provided. Said height adjusting device serves the purpose, in the inserted condition or as an alternative likewise in the recumbent condition, of performing a relative positioning between the roller carriage and the basic body. By affixing the sliding door at the basic body, the position of the basic body corresponds to the position of the sliding body, and simultaneously by placing the associated roller module into, respectively onto or to a roller running path, corresponds to the position of the roller running path and thereby to the absolute position of the door opening, so that a relative positioning between the basic body and the roller module can provide an adjustment of the height in the relative positioning between the sliding door and the door opening.

According to the disclosure, the height adjusting device is equipped with two adjusting means corresponding to each other. A first adjusting means is supported to be movable at the basic body so that an adjusting movement can be performed. Said adjusting movement may be a single movement or a combination of different movements. In this context rotary motions are as conceivable as translatory, in particular linear motions. Also movements combined of different movement components, which can be provided by means of guiding means, are conceivable for performing the adjusting movement within the scope of the present disclosure.

The second adjusting means correlates with the roller module and may be in particular configured to be static. In this case, it is an operative connection, which allows for transforming the adjusting movement into a fine-tuning movement. Said operative connection may be configured to be differently complex. While in the following mainly solutions are described, which are based on a reduced complexity, basically a form of a transmitting gear may be provided as the operative connection, in order to provide a corresponding transposition of the adjusting movement into a fine-tuning movement between the first adjusting means and the second adjusting means. Said transposition is in particular aimed at the type of movement, namely rotary, translatory, linear motions or the like, as well as at the direction of motion.

According to the disclosure, it is now possible to attach the entire roller carriage by means of its basic body to the sliding door. Subsequently, the roller module with the bearing devices attached thereto is inserted into a roller running path, such that the sliding door, via the roller module and thereby the entire roller carriage, props up on the roller running path and is disposed in a hanging position. Already, in this position, the gap is formed on the underside of the sliding door to the floor and can be measured. For modifying said gap width, the adjusting movement is now performed at the first adjusting means. The operative connection with the second adjusting means changes by performing the adjusting movement and the associated performing of the fine-tuning movement changes the relative positioning between the basic body and the roller module. Depending on the direction of the adjusting movement and, resulting therefrom, depending on the direction of the fine-tuning movement, the sliding door together with the basic body will lift or lower in relation to the roller module. As a result the gap on the underside between the floor and the lower edge of the sliding door will change. In this case, it can be very well seen, how simple, inexpensive and moreover quick the mounting with regard to adjusting the height fine-tuning can be provided.

The operative connection between the two adjusting means is provided to be preferably continuous. This means that both, prior to performing the adjusting movement and after completing the adjusting movement, said operative connection remains effective, which is in particular configured as a direct contact between the two structural components. In this case, a direction of gravity is understood to be the respective reference to the installation situation. As in particular a hanging disposition is concerned when inserting the roller module into the roller running path, the direction of gravity is in particular oriented vertically or essentially vertically to the corresponding bearing axes of associated rollers or other associated bearing means.

Another advantage can be achieved, if, in an inventive roller carriage, the latter includes a mounting device in the shape of a the lift-off protection device as a protection against removal of the roller module from the displaceable affixing in the roller running path. In this case, the lift-off protection device includes a lift-off protection means, which is supported to be movable between a protection position and a release position, as well as an arresting device for arresting the lift-off protection means in the protection position.

According to the disclosure, the roller carriage can now be equipped with a lift-off protection device. Said device serves the function of preventing deliberate or unwanted removal of the roller module. In this case, both active unhooking of the roller carriage as well as the result of jumping caused by mechanical interference or by high speed when displacing the sliding door should be prevented. In both cases, the lift-off protection device is intended to retain the roller module and in particular a bearing device of the roller module in the hooked-in contact and thereby in engagement with the displaceable affixing on the roller running path.

In order to be able to guarantee the above-described function, the inventive lift-off protection device is configured to support a lift-off protection means movable between a protection position and a release position. In this case, it is in particular question of a geometrical correlation of the lift-off protection means with the roller running path or with further structural components of a housing, in which the roller running path is disposed. Therefore, a movement of the lift-off protection device into a protection position may result in a geometrical correlation of the lift-off protection means with one surrounding structural component. Said correlation is based on a reduction of the freedom of movement of the entire roller carriage in or essentially in the direction of gravity. In other words, reducing said freedom of movement reduces the maximum lifting height, which is geometrically tolerated, if at all, by means of said remaining room for movement. The reduction is limited to a remaining room for movement, which is smaller than or equal to, in particular however, completely smaller than the maximum lifting freedom from the roller running path so that the roller module remains on the roller running path. If for example the roller running path is equipped with a convex running surface and a corresponding roller is equipped with a bearing device having a concave circumference, the depth of said concave circumference is equivalent to the maximum admissible lifting height from the roller running path. According to the disclosure it is now ensured that the maximum remaining movement possibility above the protection position of the lift-off protection means is smaller than said maximum admissible lifting height between the roller running path and the associated bearing device.

In the release position, a considerably larger freedom of movement is intended such that both, hanging the roller carriage into the roller running path and the deliberate active removal of the roller module, respectively of the roller carriage from the roller running path can be realized in a simple and most of all quick manner.

In addition to differentiating the two distinct positions, according to the disclosure an arresting device is provided, which is configured to be in particular separate from the lift-off protection device, respectively separate from the lift-off protection means. Said arresting device allows for arresting the lift-off protection means, at least in the protection position. Obviously, an arresting can be likewise realized in further positions, in particular in the release position as will be explained in detail later. Providing such an arresting option allows now for performing a two-staged mounting process. As soon as the roller carriage is placed upon, respectively into the roller running path, subsequently the lift-off protection means is moved from the release position into the protection position. While in the known state-of-the-art, the mounting process finished here, according to the disclosure, in an additional step, the arresting device is activated, and arresting the lift-off protection means in the protection position is realized. This circumstance leads to the fact that arresting prevents a movement of the lift-off protection means out of the protection position, even if high mechanical interferences have the tendency of moving the lift-off protection means out of the protection position. Said additional protection serves to even increase the application safety and in particular to prevent, at an almost 100% probability, any unwanted removal of the roller carriage out of the roller running path. This arrangement represents an important advantage, in particular in correlation with appropriate dampening elements in the terminal abutments for the roller carriage, which may result in corresponding forces acting upon the roller carriage.

Basically, in this case, the type of arresting is irrelevant. This means both, a form closure, a frictional connection and a non-positive connection may provide a corresponding arresting means. Obviously, combinations of different arresting functions following the idea of the present disclosure are conceivable. A form closure configuration of the arresting device is particularly simple and most of all cost-effective in production, at least partially. This device results in being able to provide the arresting function by means of a simple geometrical correlation of arresting means yet to be described.

In this case, the lift-off protection device may have additional functionality, in particular in the shape of provided elasticity. For example the lift-off protection means may include, at least partially, a spring-elastic configuration. In the event of a movement in the direction of gravity, this circumstance results for the roller carriage in that a contact with the lift-off protection means with the corresponding securing housing wall of a roller running path does not lead to a mechanical interference with the lift-off protection means. Such jumping in the direction of gravity is rather dampened by such spring elasticity. Accordingly and preferably, the arresting means is at least partially manufactured from spring elastic plastic material. Obviously, other components of the lift-off protection device or even a partial portion of the lift-off protection means may be manufactured from a different material, in particular from metal.

Moreover, the roller module is attached to the basic body in order to provide a sufficient protecting function. Said attachment is in particular provided with a displaceable and fixable bearing such as to allow for a basic height adjustment between the roller module and the basic body in relation to each other. Thereby an overall system of the roller carriage has been created for which the overall function of the lift-off protection device is effective.

It is likewise advantageous, if, in an inventive roller carriage, the latter, for the attachment of a first accessory module of at least two different accessory modules, as a mounting device includes at least one accessory device with a locating surface for contacting a counter-locating surface of the first accessory module and with at least one accessory attachment means for the attachment of the first accessory module.

According to the disclosure, just a single roller carriage may be provided, which can be likewise referred to as basic roller carriage. Such a basic roller carriage may be specified now by means of corresponding accessory modules and thereby specifically retrofitted or upgraded for one or more additional functions by means of appropriate accessory modules. The terminology of an accessory module according to the idea of the present disclosure, is understood to be a technical apparatus, which is able to fulfill, at least partially, at least one or more functions for the roller carriage. If for example a blocking function in one of the terminal positions of the roller carriage is desired, such an accessory module may include a corresponding bolt portion, which, in a blocking position, can stationarily latch in a terminal position of the sliding door. Accordingly other functional portions of the accessory module can be provided for other functions. According to the disclosure, the roller carriage now includes the basic functions, which can be basically provided for all application situations. These are understood to include in particular the displaceable affixing at the roller running path as well as the attachment of the sliding door. The affixing on the roller running path allows for the displaceable movement of the roller module and thereby of the roller carriage along said roller running path.

The attachment of the sliding door allows for attaching the sliding door for said movement, in order to be able to move the roller carriage together with the sliding door with regard to an opening movement and a closing movement.

In the event now one or more additional functions are desired, the person realizing the mounting process at the installation site has several accessory modules available. In this case, the different accessory modules are in particular each specifically directed to exactly one or more additional functions. In the event a defined specific additional function is desired, the associated correlating specific accessory module is selected as the first accessory module. With the inventive configuration of an accessory device, the latter is so to say configured as a universal accessory interface. Said universal configuration of the accessory device, which is in particular expressed by the universal correlation and configuration of the locating surface as well as the accessory attachment means, basically it is now possible to attach two or more different accessory modules to the accessory device. Obviously, in an accessory device in particular only a single accessory module can be attached at the same time. However, which of the different accessory modules is to attached as said first accessory module, can be freely selected.

As can be seen from the above explanation, the flexibility for a basic configuration of an inventive roller carriage is significantly increased. In particular all accessory functions can be offered as an upgrade of said roller carriage by correspondingly attaching the corresponding specific accessory module to the accessory device. In this case, a single universal roller carriage may be provided, which at reduced complexity is able to fulfill any number of different additional functions. In this case, it may be advantageous, if one or more accessory devices are provided such that even two or more accessory modules can be attached in parallel and thereby simultaneously to the roller carriage. While for different combinations of additional functions according to the state-of-the-art, different specific roller carriages were required, now a universal roller carriage can be upgraded by means of corresponding specific additional modules. The complexity of different additional functions is thereby reduced to specific accessory modules, which, based on their dimensions and complexity, can be manufactured at considerably reduced expense and cost. Another decisive advantage is found in that the basic configuration and the universal interface function of the accessory device allow for combining such a roller carriage essentially optional with different accessory modules, such as to, even based on the specific accessory module, the complexity with regard to the optional choice of combination of different additional functions in a roller carriage is considerably reduced.

Furthermore, it is conceivable that the locating surfaces according to the present disclosure can be configured to be completely optional. Thus, the locating surface and the counter-locating surface may present flat or at least partially flat extensions. Also differently oriented flat portions of the locating surface and of the counter-locating surface are conceivable according to the idea of the present disclosure. Also locating surfaces or counter-locating surfaces formed to be completely bare can be employed, as well as curved configurations of said surfaces. This circumstance allows for example for generating an at least partial form closure, as will be explained in the following.

Accessory attachment means are understood as structural components, which serve for the attached disposition of the accessory module. For this purpose reversible or irreversible acting accessory attachment means may be employed. For example threaded holes with a corresponding threaded bolt can be employed as accessory attachment means. Also irreversible solutions, such as riveting or at least partial bonding are possible according to the idea of the present disclosure as accessory attachment means.

Another subject matter of the present disclosure is a sliding door installation including a roller running path, and at least one inventive roller carriage, which is supported in the roller running path to be displaceable. Preferably, even two roller carriages are provided, which include at least one sliding door and are supported in the roller running path to be displaceable. The inventive sliding door installation thus offers the same advantages as those described in detail with regard to an inventive roller carriage.

BRIEF DESCRIPTION OF THE DRAWINGS

Further advantages, features and details of the disclosure will result from the following description, in which exemplary embodiments of the disclosure are described in detail. In the drawings.

DETAILED DESCRIPTION OF THE DRAWINGS

Figure 1:
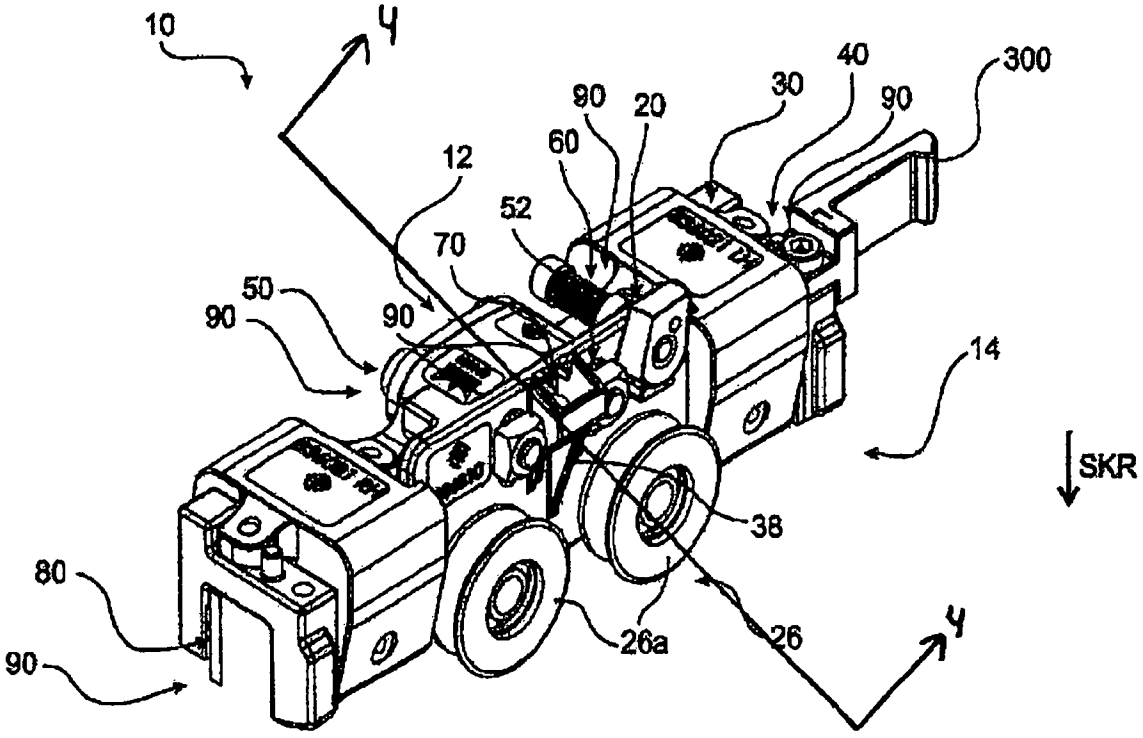
FIG. 1 an embodiment of a roller carriage.

An embodiment of a roller carriage 10 is illustrated in an isometric illustration in FIG. 1. Basically, said carriage includes two structural components. In this case, the components are the roller module 20 on the one hand and, on the other hand, the basic body 30. In this case, both structural components, namely the roller module 20 and the basic body 30 include a plurality of individual parts. Said individual parts will be briefly explained in the following.

Figure 3:
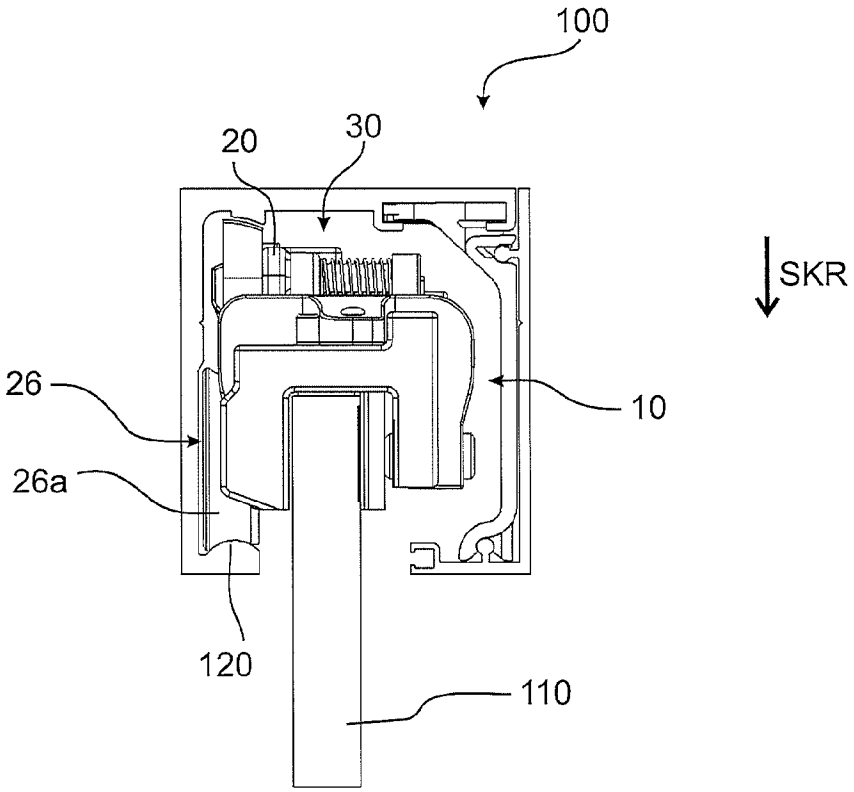
FIG. 3 a lateral illustration of a roller carriage in a roller running path, FIG. 4 a lateral illustration of a roller carriage in cross-section, FIG. 5 the illustration of FIG. 4 in an isometric view, FIG. 6 an illustration of a mounting device in the shape of a height adjusting device, FIG. 7 an illustration of different mounting devices from the first side, FIG. 8 an illustration of a manipulation tool prior to engagement, and FIG. 9 the manipulation tool according to FIG. 8 during engagement.
Figure 5:
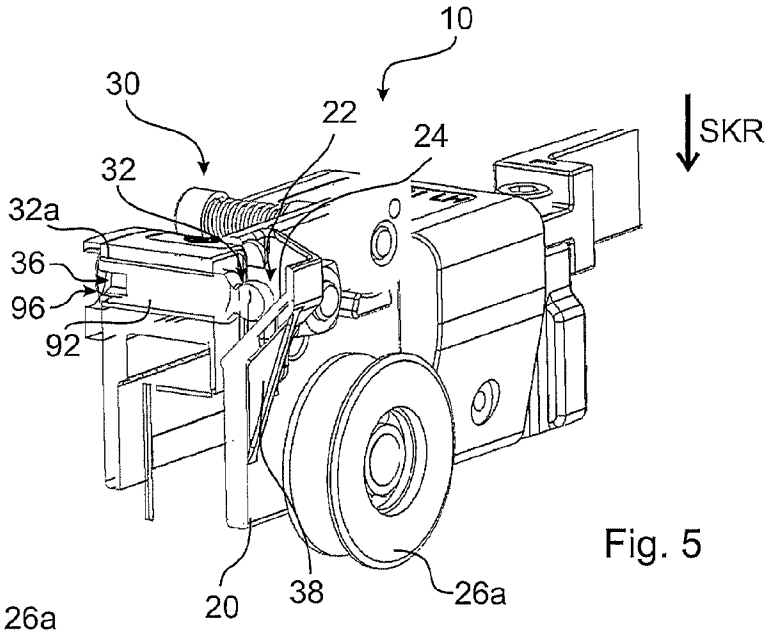
Figure 4:
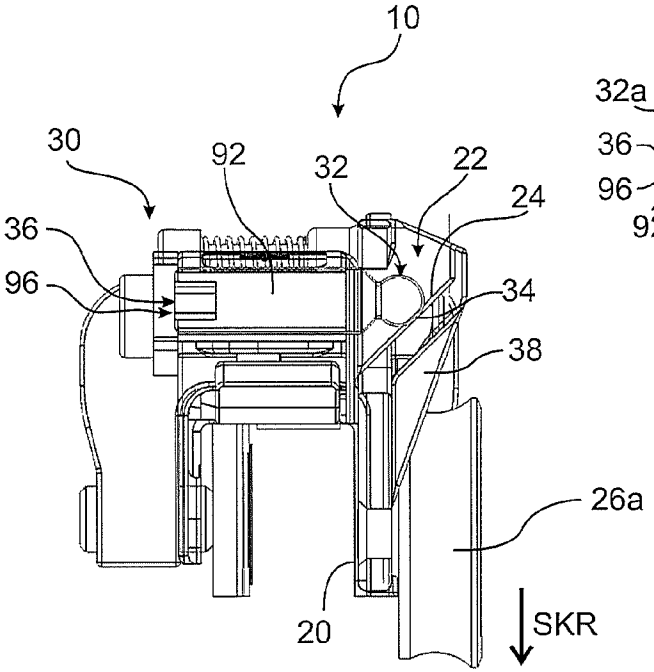

Here, the roller module 20 is equipped with a bearing device 26. Said bearing device 26 is equipped in this case with two rollers 26*a*, which are supported to be rotatable at a basic body of the roller module 20. Said rollers 26*a* can be placed onto, respectively inserted into a roller running path 120, as can be clearly seen in FIG. 2 and FIG. 3. A part of a height adjusting device 70 is provided furthermore at the roller module 20. The detailed components of said height adjusting device 70 are in particular illustrated in FIGS. 4 and 5. Thus, a first adjusting means 32 is provided, which by means of a manipulation interface 36 is able to perform an adjusting movement. As in this case, the first adjusting means 32 is configured as a threaded bolt in an adjusting thread 32*a*, a rotary motion is performed at the manipulation interface, which motion simultaneously produces a linear translatory motion of the first adjusting means 32. Via a corresponding contacting portion 34, the first adjusting means 32 is in an operative connection with a counter-contacting portion 24 of the second adjusting means 22. In this case, the explicit action of said adjusting device includes transforming the adjusting movement into a fine-tuning movement along the direction of gravity SKR.

As can be seen in FIG. 1, the roller carriage 10 is equipped with a plurality of different mounting devices 90, which are able to provide different mounting functions. In this case, the already described fine-tuning function of the height of the sliding door 110 is provided by means of the mounting device 90 in the shape of a height adjusting device 70. Furthermore, a mounting device 90 in the shape of a securing device 50 is provided, which, after completed fine-tuning of the height of the sliding door 110, provides a clamped fixing between the basic body 30 and the roller module 20.

In this case, a further mounting device 90 includes an accessory device 40, which is provided by means of a corresponding interface and an affixed accessory module 300. Moreover, a lift-off protection device 60 is provided as a mounting device 90, which provides a lift-off protection against unwanted removal of the roller carriage 10 out of the position in which it is inserted into the roller running path 120. Furthermore, an attachment device 80 is provided as a glass clamp for a mounting device 90, in order to affix the sliding door 110 in a clamping manner.

All mounting devices have in common that they include at least one mounting means 92, in order to be able to perform a corresponding mounting movement. Moreover, a manipulation interface is provided, intended to allow for performing exactly said mounting movement with the mounting means.

As furthermore revealed in FIG. 1, the roller carriage 10 has different sides, namely the first side 12 and the second side 14. In this case with regard to their manipulation interface 96, all mounting devices are preferably aligned on the same side, namely the first side 12 opposite the second side 14, on which the bearing device 26 is disposed. This arrangement offers a considerably simpler access.

Figure 2:
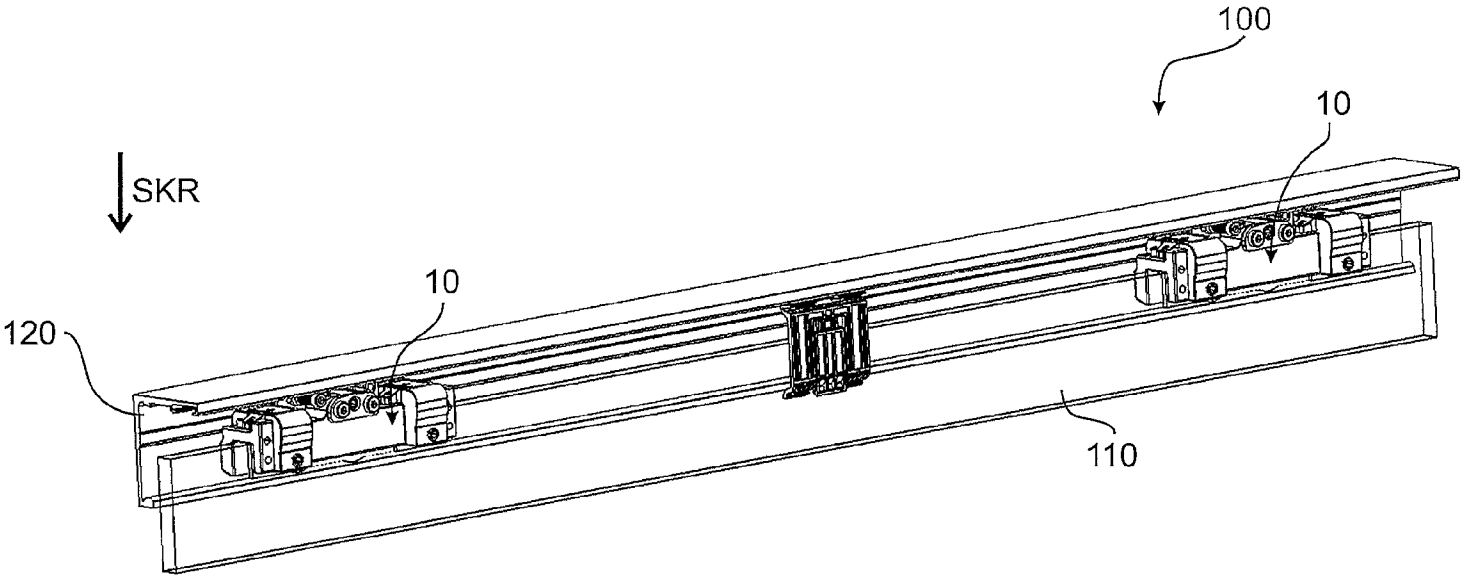
FIG. 2 an embodiment of a sliding door installation.

FIG. 2 reveals how a sliding door 110 is retained by means of two roller carriages 10 according to FIG. 1, and that the two roller carriages 10 are already inserted into the roller running path 120. In a lateral illustration according to FIG. 3, in particular the correlation of the rollers 26*a* with the roller running path 120 is well visible.

Figure 6:
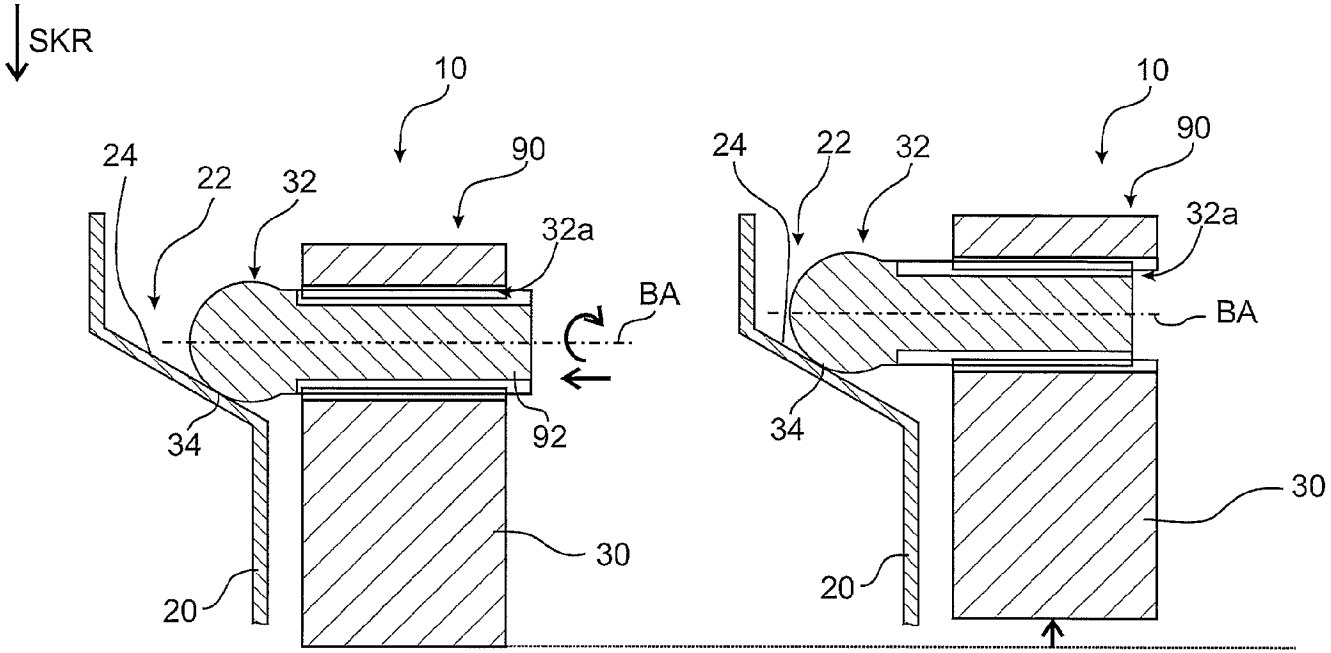

FIG. 6 illustrates a height adjusting device. Said FIG. 6 shows a solution, in which the first adjusting means 32 performs a combination of rotary motion and linear motion. The first adjusting means 32, configured as a threaded bolt, is rotated in an adjusting thread 32*a* about an axis of movement BA and moves in this way in FIG. 6 from the right side to the left side. A contacting portion 34*a* slides thereby on a counter-contacting portion 24 and lifts the entire basic body 30 in relation to the roller module 20. And as the sliding door 110 is attached to the basic body 30, the sliding door 110 is thereby lifted as well.

Figure 7:
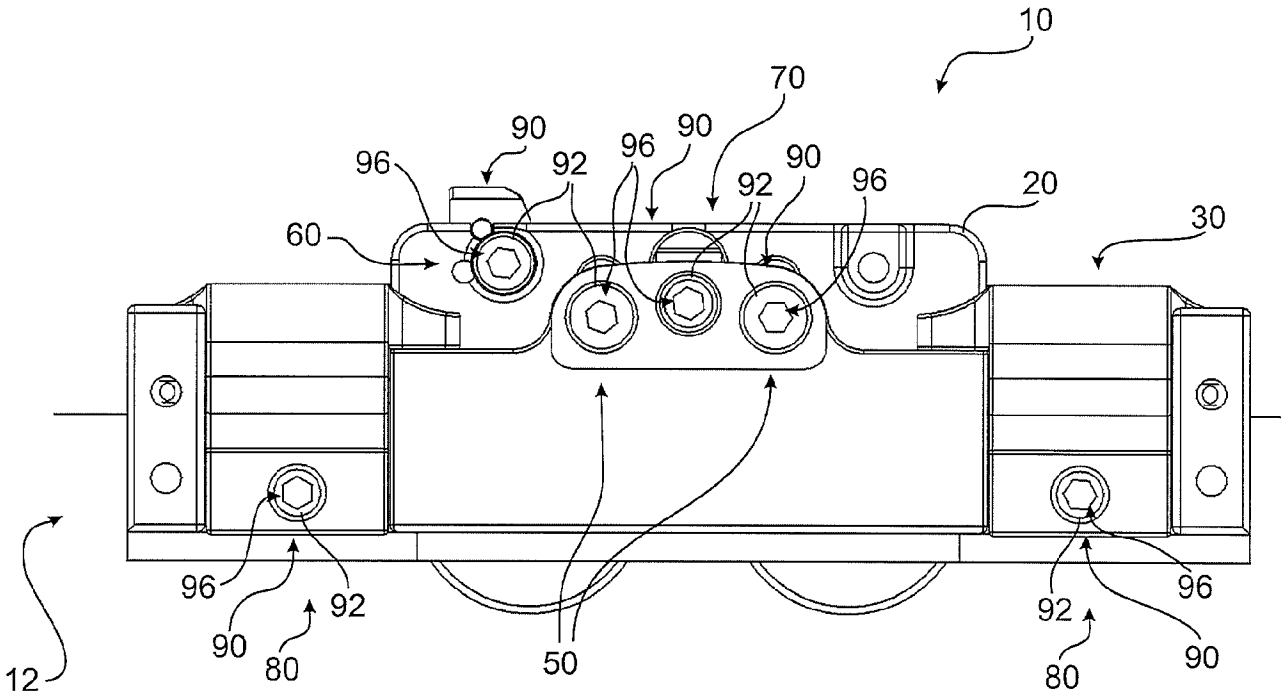

FIG. 7 illustrates the roller carriage 10 from the first side 12. In this case, it is the view of an installation technician in the mounting position. The roller carriage 10 is thus shown in the position, in which its bearing device 26 is inserted into the corresponding roller running path 120. It can be very well seen that respectively one or more mounting means 92 are provided for a plurality of different mounting devices 90, namely an attachment device 80 on the right, an attachment device 80 on the left, a lift-off protection device at the top left, and a height adjusting device 80 at the top center. In this case, the axes of movement BA of all said mounting means 92 are aligned in parallel and point out of the plane of the drawing in FIG. 7. At the same time, the manipulation interfaces 96 can be seen for all mounting means 92. All said manipulation interfaces 96 include a form closure portion 96*a*, as can be seen for example very well in FIGS. 8 and 9. FIG. 7 now represents the image offered to the installation technician. One single s manipulation tool 200 is sufficient to be able to perform all mounting functions of all mounting devices 90. Thus, all manipulation interfaces 96 in the same alignment can be accessed with the same type of movement of the mounting movement with the same manipulation tool 200 from said first side 12, as the front side. At this point, the high reduction of complexity and thereby the intuitive serviceability according to the present disclosure is well visible.

Figure 8:
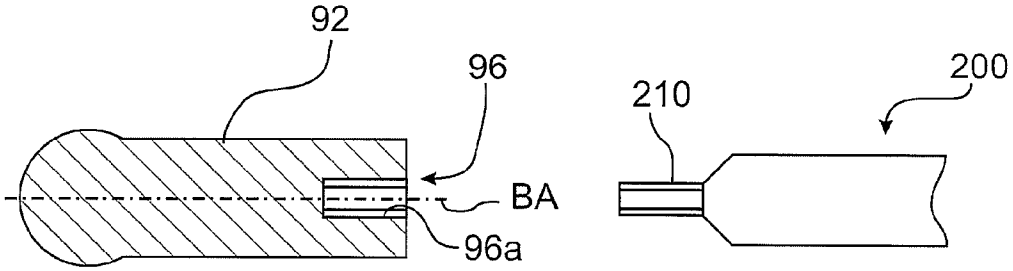
Figure 9:
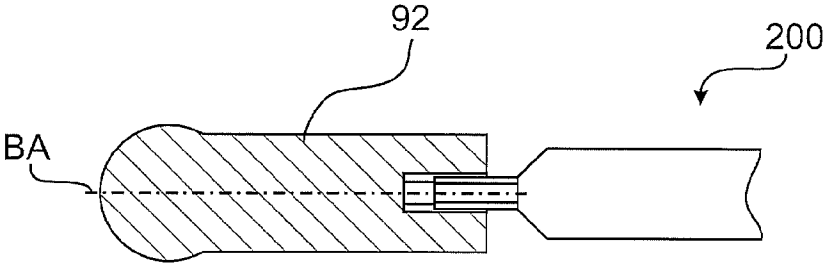

FIGS. 8 and 9 shows one possibility of the correlation with a uniform manipulation tool 200. The latter includes an interface portion 210, which for example may be configured as a hexagon or as a slotted screwdriver or as a cross-headed screwdriver. In a correlating manner, a corresponding form closure portion 96*a* is provided in a mounting means 92, so said manipulation interface 96 is able to cooperate with said manipulation tool 200. In this case, FIGS. 8 and 9 show the cooperating position and the position, in which the manipulation tool 200 is removed.

The above explanation of the embodiments describes the present disclosure exclusively based on examples.

Obviously, individual features of the embodiments, as long as technically reasonable, can be combined independently of each other without leaving the scope of the present disclosure.

The invention claimed is:

1. A roller carriage for the reception of a sliding door, including a roller module for displaceable affixing at a roller running path and a basic body for attachment to the sliding door, wherein at least two mounting devices are provided for configuring one mounting function of the roller carriage, wherein each mounting device includes at least one mounting means with a manipulation interface for applying a mounting force for performing a mounting movement of the at least one mounting means, wherein each manipulation interfaces of the mounting means of the at least two mounting devices is disposed on a first side of the roller carriage, and a bearing device of the roller module for the displaceable affixing at the roller running path is disposed on a second side of the roller carriage, which is located opposite the first side, wherein each manipulation interface includes at least one form closure portion, which forms an at least partial form closure with an interface portion of a uniform manipulation tool, wherein at least one of the following mounting devices is provided:

a height adjusting device for a height adjustment of the basic body in relation to the roller module in a direction of gravity, an attachment device for an attachment of the sliding door to the basic body, a lift-off protection device for protection against a lifting of the roller carriage out of the roller running path, a securing device for a secured affixing of the displaceable bearing of the basic body at the roller module, and an accessory device for attachment of an accessory module to the basic body or to the roller module.

2. The roller carriage according to claim 1, wherein each manipulation interfaces of all mounting means of all mounting devices is disposed on the first side of the roller carriage.

3. The roller carriage according to claim 1, wherein all mounting means include a positioning for a mounting movement.

4. The roller carriage according to claim 1, wherein all mounting means include an axis of movement for the mounting movement, wherein the axes of movement are aligned essentially parallel to each other.

5. The roller carriage according to claim 1, wherein the bearing device of the roller module includes at least one rotatable roller.

6. The roller carriage according to claim 1, wherein each mounting means presents a mechanical load-bearing capacity with regard to receiving the mounting force in a range of at least one of the following parameters:

torque higher than or equal to 5 Nm, and

E-modulus larger than or equal to 210 $kN/mm^2$.

7. The roller carnage according to claim 1, wherein the basic body is supported at the roller module to be displaceable along a direction of gravity for a fine-tuning movement, wherein a first adjusting means for an adjusting movement is supported at the basic body to be movable, wherein, for a movement of the basic body along a direction of gravity in relation to the roller module when performing the adjusting movement, the first adjusting means is in operative connection with a second adjusting means of the roller module.

8. The roller carriage according to claim 1, wherein the lift-off protection device includes a lift-off protection means, which is movable between a protection position and a release position, as well as an arresting device for arresting the lift-off protection means at least in the protection position.

9. The roller carriage according to claim 1, wherein the roller carriage configured for attaching a first accessory module of at least two different accessory modules, as the mounting devices, includes at least one accessory device with a locating surface for contacting a counter-locating surface of the first accessory module, and at least one accessory attachment means for attaching the first accessory module.

10. A sliding door installation, including a roller running path and at least one roller carriage according to claim 1 and supported in the roller running path to be displaceable.

11. The sliding door installation according to claim 10, wherein the sliding door is supported in the roller running path to be displaceable by means of at least two roller carriages.

* * * * *